United States Patent [19]

Suzuki et al.

[11] Patent Number: 4,872,117

[45] Date of Patent: Oct. 3, 1989

[54] APPARATUS FOR CONTROLLING AN AIR-FUEL RATIO IN AN INTERNAL COMBUSTION ENGINE

[75] Inventors: Fujiyuki Suzuki; Akira Osada, both of Hamamatsu, Japan

[73] Assignee: Suzuki Jidosha Kogyo Kabushiki Kaisha, Shizuoka, Japan

[21] Appl. No.: 132,682

[22] Filed: Dec. 14, 1987

Related U.S. Application Data

[63] Continuation-in-part of Ser. No. 802,550, Nov. 27, 1985, abandoned.

[30] Foreign Application Priority Data

Nov. 30, 1984 [JP] Japan ..... 59-253096
Nov. 30, 1984 [JP] Japan ..... 59-253097

[51] Int. Cl.[4] ..... F02B 3/00

[52] U.S. Cl. ..... 364/431.05; 123/440; 123/489; 123/491

[58] Field of Search ..... 364/431.05, 431.06, 364/431.07, 442; 123/437, 438, 440, 489, 491

[56] References Cited

U.S. PATENT DOCUMENTS

| | | | |
|---|---|---|---|
| 4,086,884 | 5/1978 | Moon et al. | 364/442 |
| 4,290,107 | 9/1981 | Suda et al. | 364/431.06 |
| 4,349,877 | 9/1982 | Oyama et al. | 123/438 |
| 4,430,976 | 2/1984 | Kondo et al. | 364/431.06 |
| 4,445,481 | 5/1984 | Aoki et al. | 123/489 |
| 4,539,958 | 9/1985 | Ito et al. | 123/488 |
| 4,556,033 | 12/1985 | Ito et al. | 364/431.06 |
| 4,572,135 | 2/1986 | Nakajima et al. | 123/489 |
| 4,580,539 | 4/1986 | Kitahara | 123/491 |
| 4,583,174 | 4/1986 | Watanabe | 364/431.05 |
| 4,635,200 | 1/1987 | Egani et al. | 364/431.07 |

FOREIGN PATENT DOCUMENTS

| | | |
|---|---|---|
| 57-35138 | 2/1982 | Japan . |
| 57-73840 | 5/1982 | Japan . |
| 58-35246 | 3/1983 | Japan . |
| 58-172442 | 10/1983 | Japan . |
| 59-32644 | 2/1984 | Japan . |
| 61-132740 | 6/1986 | Japan . |
| 61-132741 | 6/1986 | Japan . |

*Primary Examiner*—Parshotam S. Lall
*Assistant Examiner*—V. N. Trans
*Attorney, Agent, or Firm*—Flynn, Thiel, Boutell & Tanis

[57] ABSTRACT

An air-fuel ratio control apparatus for an internal combustion engine supplies an output signal from an $O_2$ sensor detecting the concentration of oxygen in the exhaust gas to an electronic control unit having a microcomputer, and a control valve of the carburetor is controlled by a control signal from the microcomputer so as to control the air-fuel ratio in a feedback manner. A desired upper limit value is set for the control signal and, when the control signal exceeds this upper limit value in a transient operating condition of the engine, when its operating state is shifted from an idling state to a partial operating state, the microcomputer promptly changes the rich air-fuel ratio to a proper value. According to a preferred form of the invention, the control constant of the air-fuel ratio correction value is set to a large value for only a predetermined period of time in the transient operating condition of the engine, thereby correcting and controlling the air-fuel ratio to a proper value in a feedback manner. In this way, the quantity of gases such as CO or the like in the exhaust can be minimized.

6 Claims, 9 Drawing Sheets

IDLING SWITCH
(More than idling)
OFF
ON (Idling state)

$O_2$ SIGNAL
RICH
LEAN

CORRECTION SIGNAL
LEAN
UPPER LIMIT VALUE
RICH
54
50
60
62
52
56
$K_2$
$K_1$
70
58
OVER THE UPPER LIMIT VALUE IS DETECTED
OPERATIVE POSITION IN THE IDLING STATE
72

CO or A/F
%
64

APPARATUS FOR CONTROLLING AN AIR-FUEL RATIO IN AN INTERNAL COMBUSTION ENGINE

This application is a continuation-in-part of U.S. Ser. No. 802,550 filed Nov. 27, 1985, now abandoned.

FIELD OF THE INVENTION

The present invention relates to an apparatus for controlling an air-fuel ratio in an internal combustion engine and, more particularly, to an apparatus of this type which can decrease the amount of harmful exhaust components in the transient operating state of the engine when the engine condition is shifted from the idling operating state, and the invention also relates to an apparatus for controlling an air-fuel ratio of an internal combustion engine which can clean the exhaust gas in a transient operating state when the engine is shifted from the idling operating condition to a partial operating condition.

BACKGROUND OF THE INVENTION

In internal combustion engines for motor vehicles, there are large variations in the running velocity of the vehicle, namely in the rotating speed of the engine and the load, and high performance characteristics such as low fuel consumption, production of a minimal quantity of harmful exhaust gases and the like are required in various kinds of operating conditions in combination with both of these variation factors. For this purpose, the air-fuel ratio must be properly controlled in accordance with various kinds of operating conditions of the engine.

As a method of properly controlling the air-fuel ratio, there has been used an air-fuel ratio control apparatus of the feedback type in which an exhaust gas sensor is provided to detect the concentration of a specific component in the exhaust gases, for example an $O_2$ sensor to detect the concentration of oxygen, and a control valve is provided to control the supply quantity of bleed air and is made operative in response to an output signal from the $O_2$ sensor to thereby adjust the air-fuel ratio. In this way, the air-fuel ratio is properly controlled so as to always obtain the best combustion condition in accordance with the various kinds of operating states.

With this control apparatus, however, in the transient operating state in which the engine operating condition is shifted from the idling operating state to the partial or acceleration operating state or to the operating state at a high altitude, then as shown in FIGS. 1 and 2, the correcting operation width H of the air-fuel ratio required in operating conditions at a high altitude is larger than the correcting operation width h needed for normal operating conditions at a standard low altitude, due to the decrease in the air concentration and the like. This causes the control of the air-fuel ratio by way of a correction signal to be delayed after an increase in engine speed, so that there is the drawback that the air-fuel ratio is enriched and the quantity of CO as a harmful exhaust component is increased, for example by an amount indicated by the hatched region in FIG. 4D.

On the other hand, in conventional air-fuel ratio control devices for internal combustion engines, an output signal from an exhaust sensor, for example an $O_2$ sensor, is inputted to the electronic control unit (ECU), and the valve provided in the carburetor is controlled by this ECU in a feedback manner, thereby controlling the air-fuel ratio.

However, in such conventional control devices, as mentioned above, the correcting operation width in the operating condition of the engine at a high altitude becomes larger than that in the normal operating condition at a standard low altitude in the transient operating condition in which the engine operating state is shifted from the idling state to the partial operating state, as shown in FIGS. 1 and 2.

Consequently, the correcting of the air-fuel ratio is delayed, causing the drawback that the quantity of CO produced as a harmful exhaust gas is increased as a result of the enriched air-fuel ratio, as indicated by the hatched region in FIG. 6D.

SUMMARY OF THE INVENTION

It is a first object of the present invention to provide an air-fuel ratio control apparatus for an internal combustion engine which can reduce harmful exhaust components in the transient operating condition of the engine when the engine is shifted from the idling operating state and which can help to clean the exhaust gas.

It is a second object of the invention to provide an air-fuel ratio control apparatus for an internal combustion engine in which the control constant of the correction value of the air-fuel ratio is set to be large for only a predetermined period of time in the transient operating condition when the engine is shifted from the idling operating state to the partial operating state, thereby promptly making the rich air-fuel ratio lean and enabling harmful exhaust gases such as CO or the like to be reduced.

The first object is accomplished by providing an air-fuel ratio control apparatus for an internal combustion engine which includes: an exhaust sensor to detect the concentration of an exhaust gas; an idling switch to detect the transient operating condition when the engine is shifted from the idling state; an electronic control unit which has a microcomputer and receives output signals from the exhaust sensor and the idling switch and then generates a control signal, a desired upper limit value being set for the control signal; and an electronically controlled carburetor having a control valve which controls the air-fuel ratio of the engine in response to the control signal from the electronic control unit This control apparatus is characterized in that, when the control signal exceeds the set upper limit value in the transient operating condition, the microcomputer outputs the control signal to the control valve in a manner causing the rich air-fuel ratio to be rapidly changed to a proper air-fuel ratio. Thus, a harmful exhaust gas component such as CO or the like can be reduced.

The second object is attained by providing an air-fuel ratio control apparatus of the type mentioned above, which is characterized by a control constant of the air-fuel ratio correction value being set to a large value for only a predetermined period of time in the transient operating condition when the engine is shifted from the idling state to the partial operating state, thereby correcting and controlling the air-fuel ratio in a feedback manner. Thus, the quantity of harmful exhaust gases such as CO or the like can be reduced.

According to one aspect of the invention, the exhaust sensor is an $O_2$ sensor to detect the concentration of oxygen in the exhaust gas.

According to another aspect of the invention, the electronic control unit has a timer and, when the time of the timer is longer than a preset time, the control valve operates on the basis of a normal control constant ($R_1$) of the air-fuel ratio correction value, whereas when the time of the timer is shorter than or equal to the preset time, the control valve operates on the basis of a special control constant ($R_2$) larger than the normal control constant ($R_1$) for a predetermined period of time.

The above and other objects, features and advantages of the present invention will be apparent from the following detailed description in conjunction with the accompanying drawings.

BRIEF DESCRIPTION OF THE DRAWINGS

Embodiments of the present invention will now be described in detail hereinbelow with reference to the drawings, in which.

DETAILED DESCRIPTION

Figure 1:
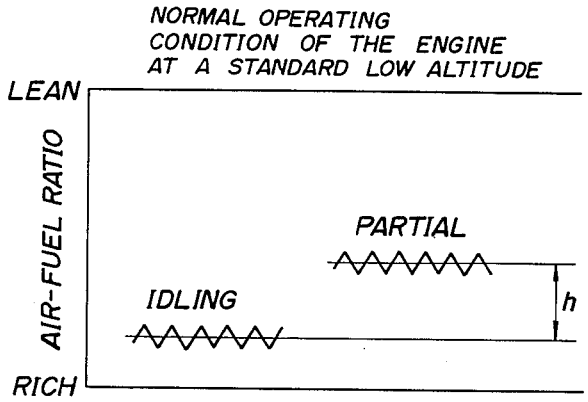
FIG. 1 PRIOR ART
FIG. 1 is a graph showing a change in an air-fuel ratio correction signal in an operating condition of the engine at a standard low altitude.
Figure 2:
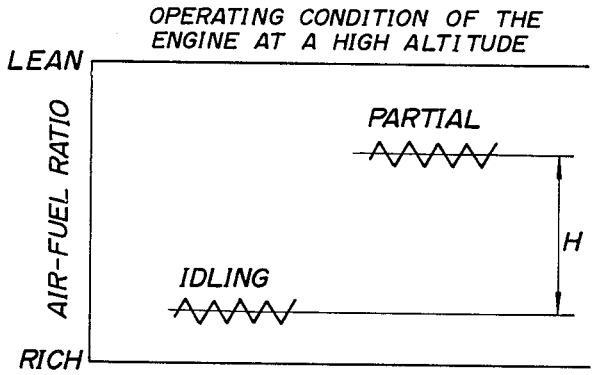
FIG. 2 PRIOR ART
FIG. 2 is a graph showing the change in the air-fuel ratio correction signal in an operating condition of the engine at a high altitude.
Figure 3:
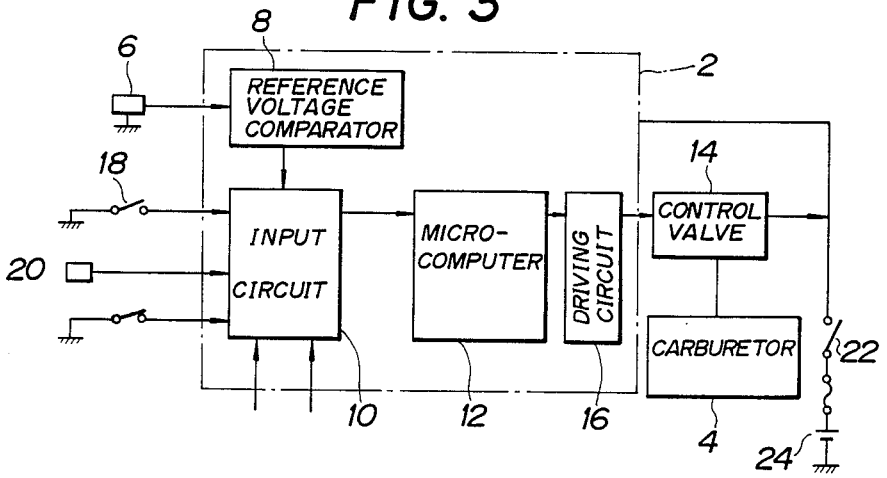
FIG. 3 is a block diagram of an air-fuel ratio control apparatus according to an embodiment of the present invention.
Figure 4A:
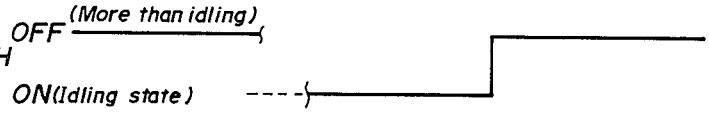
FIGS. 4A to 4D are respective timing charts showing operational characteristics of one embodiment of the invention.
Figure 4B:
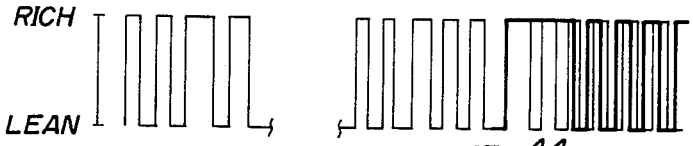
Figure 4C:
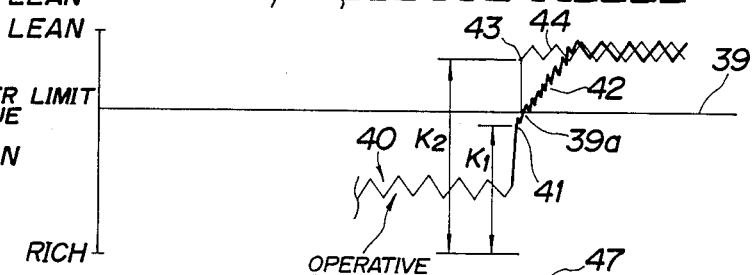
Figure 4D:
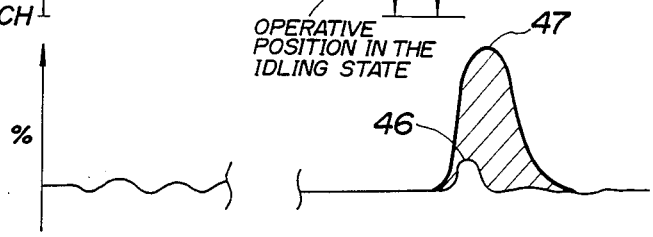
Figure 5:
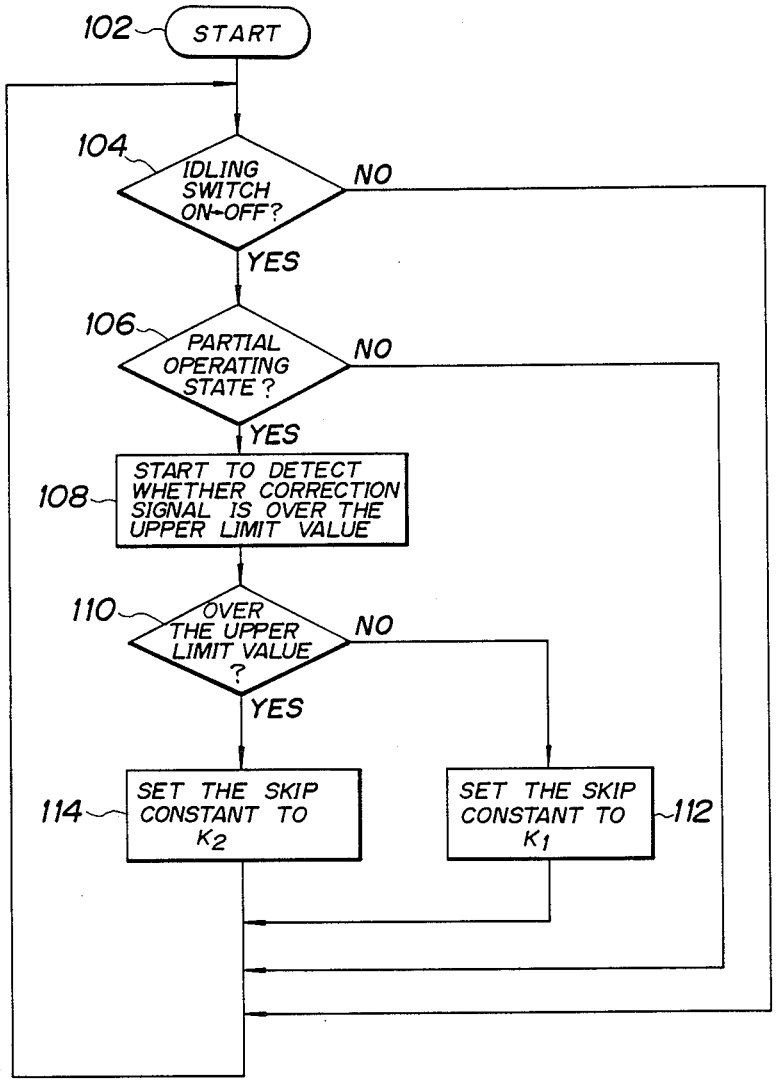
FIG. 5 is a flowchart of the operation of the first embodiment.

FIGS. 3 to 5 show one embodiment of the invention. In FIG. 3, an electronic control unit (ECU) 2 is a principal control circuit section to control an air-fuel ratio of a carburetor 4 in a feedback manner. The exhaust system is provided with an $O_2$ sensor 6 which serves as an exhaust gas sensor to detect the concentration of oxygen in the exhaust gases. The ECU 2 includes: a reference voltage comparator 8 which compares a voltage signal received from the $O_2$ sensor 6 with a reference voltage value; an input circuit 10 adapted to receive detection signals from various kinds of sensors to detect the operating condition of the engine; a microcomputer 12 to control the operating condition of the engine on the basis of an output signal from the input circuit 10; and a driving circuit 16 which outputs an air-fuel ratio correction signal received from the microcomputer 12 to a control valve 14. An idling switch 18 for detecting the open and closed states of a throttle valve of the carburetor and an engine speed sensor 20 for detecting the rotating speed of the engine are connected to the input circuit 10. Other detecting devices for detecting other operating conditions of the engine could also be connected to the input circuit 10.

The comparator 8 compares the analog output of the sensor 6 to a predetermined reference voltage, and produces a digital signal which is respectively high and low when the output of the sensor 6 is respectively above and below the reference voltage.

FIGS. 4A to 4D are timing charts to explain this embodiment. FIG. 4A shows the timing of the idling switch 18. This idling switch is on when the engine is in an idling operating state. FIG. 4B shows the timing of a signal which is output from the voltage comparator 8 and which indicates whether the concentration of oxygen in the exhaust gases is rich or lean. FIG. 4C shows the timing of the air-fuel ratio correction signal supplied to the control valve 14. FIG. 4D shows a time-dependent change in the quantity of CO in the exhaust gas.

In this embodiment, as shown in FIG. 4C, an upper limit value 39 for the air-fuel ratio correction signal is set in the microcomputer 12 of the ECU 2. The microcomputer 12 is also provided with a control circuit to detect the transient operating condition of the engine when the engine operating condition is shifted from the idling operating state to a partial operating state, an accelerating operating state, an operating state at a high altitude, or the like. In the case where the air-fuel ratio correction signal exceeds the set upper limit value, this control circuit rapidly changes the correction signal to promptly change the rich air-fuel ratio to a lean air-fuel ratio, namely by increasing the skip amount. Reference numeral 22 denotes an ignition switch, and reference numeral 24 designates a battery.

The operation of this embodiment of the invention will now be described hereinbelow with reference to the flowchart of FIG. 5.

The internal combustion engine is first actuated or started (step 102), and then a check is made to see if the idling switch 18 has changed from on to off (step 104). If the idling switch is still on, the feedback control of the air-fuel ratio is performed in accordance with the air-fuel ratio correction signal from the ECU 2. On the other hand, if it is determined in step 104 that the idling switch 18 has changed from on to off, a check is made to see if the operating condition of the engine has shifted from the idling state to the partial operating state in the transient operating state (step 106). If it is determined in step 106 that the engine is not in the partial operating state, the abovementioned feedback control is likewise carried out. On the other hand, if it is determined that the engine is in the partial operating state in step 106, the microcomputer 12 initiates a detection of the upper limit value of the air-fuel ratio correction signal (step 108). A check is made to see if the correction signal has exceeded the upper limit or not (step 110). If not, the air-fuel ratio correction signal is controlled on the basis of the skip constant $K_1$ as shown in FIG. 4C (step 112). On the other hand, if the correction signal has exceeded the upper limit value, the air-fuel ratio correction signal is controlled on the basis of the skip constant $K_2$ as shown in FIG. 4C (step 114). The skip constant $K_2$ is larger than the skip constant $K_1$. Due to this method, when the engine operating state is shifted from the idling operating state to the partial operating state, the air-fuel ratio correction signal is quickly changed, as indicated by the thin line in FIG. 4C. In this way, the correction signal can be rapidly changed to the air-fuel ratio correction value in the partial operating state.

More specifically, referring to the leftmost portions of FIGS. 4B and 4C, the control unit 2 carries out normal feedback control by slowly increasing the richness of the air-fuel ratio when the detector 6 indicates that the exhaust gases have a low concentration of $O_2$, and slowly leans the air-fuel ratio when the detector indicates that the exhaust gases have a high concentration of $O_2$ As shown in FIG. 4C, these changes in the air-fuel ratio occur at a slow rate having a predetermined slope.

When the engine is in the idling state, the idling switch 18 is on and the air-fuel ratio is being controlled at a relatively rich value, as shown at 40 in FIG. 4C. Following a change in the engine operating state from the idling state to the partial operating state in the transient operating state, the idling switch 18 changes from on to off, and the air-fuel ratio is almost instantaneously changed or skipped to a constant value $K_1$ (at 41) and thereafter is changed at the predetermined rate or slope, as shown at 42. In contrast, according to the invention, when the idling switch changes from on to off and the engine is in its partial operating state, a check is made to see whether the correction signal has exceeded a predetermined limit value 39. If the limit value 39 has not been exceeded, the air-fuel ratio is promptly changed to the constant value $K_1$ in the manner described above and then normal feedback control is resumed at 42, whereas if and when the limit value is exceeded, as at 39*a*, the air-fuel ratio is promptly changed to the constant value $K_2$ at 43 and then normal feedback control is resumed at 44.

As mentioned above, when the engine shifts from the idling operating state to the transient operating state in a conventional system, particularly in the operation of the engine at a high altitude, the air-fuel ratio correction signal is delayed in reaching a value which produces a lean air-fuel ratio, as shown by the thick line at 42 in FIG. 4C, so that the quantity of CO is significantly increased, as shown by the hatched region in FIG. 4D. However, according to the present invention, as shown at 43 in FIG. 4C, by setting the skip amount of the air-fuel ratio correction signal to a large value (skip constant $K_2$) when the upper limit value has been exceeded, a lean air-fuel ratio is achieved sooner and the significant increase in the quantity of CO is prevented, as represented by the thin line in FIG. 4D. Thus, the quantity of CO as a harmful exhaust component can be reduced, thereby contributing to cleaning of the exhaust gas.

In particular, as shown in FIG. 4D, the inventive method causes the concentration of CO in the exhaust to peak at 46, whereas use of the standard feedback control scheme would cause the concentration of CO to peak at a much higher value 47. The inventive method thus results in a significant reduction in the quantity of CO issued in the exhaust gases.

Although the upper limit value for the air-fuel ratio correction signal was set to a single value in the foregoing embodiment, a plurality of different upper limit values may be used and a different skip constant $K_n$ for each upper limit value may be provided to facilitate setting the air-fuel ratio to a suitable value.

In addition, although the shift of the engine from the idling operating state to the transient operating state has been detected using the idling switch 18, the transient operating state may be also detected by any other appropriate sensing device, such as a vacuum switch, an acceleration switch, a sensor to detect a high altitude, or the like. Further, the transient operating state could also be detected by a combination of the above-mentioned detecting devices.

As will be apparent from the foregoing description of the embodiment utilizing a desired upper limit value to control the output signal of the electronic control unit, if the output signal exceeds the set upper limit value when the engine is shifted to the transient operating condition from the idling operating condition, the air-fuel ratio is quickly changed to the proper value, thereby reducing the quantity of harmful components such as CO and the like in the exhaust and making it possible to contribute to the cleaning of the exhaust gas.

In the case of a conventional ECU having a microcomputer, the inventive control operation of the air-fuel ratio as mentioned above can be easily realized by merely changing a control program of the microcomputer, and the effect mentioned above can be achieved. Further, this embodiment can reduce costs and is practically useful.

Figures 6A, 6B, 6C, 6D:
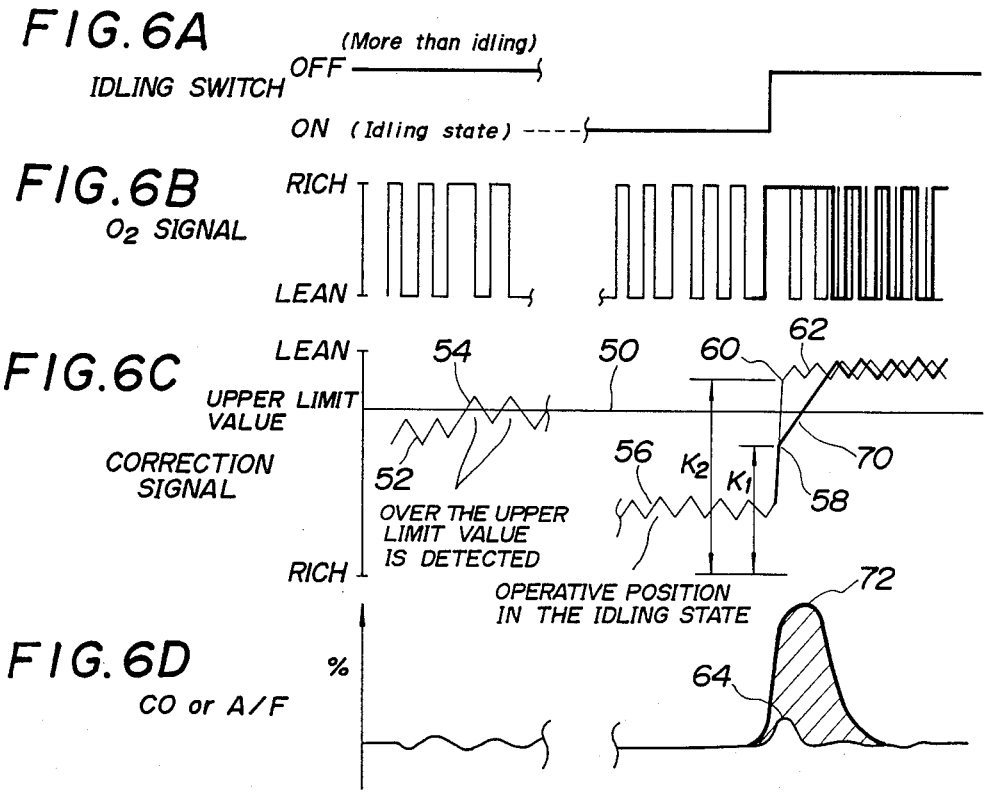
FIGS. 6A to 6D are timing charts showing operational characteristics of a second embodiment of the invention.

The second embodiment of the present invention will now be described with reference to FIGS. 6A to 6D and FIG. 7. The components of the air-fuel ratio control apparatus of the second embodiment are similar to those in the foregoing embodiment shown in FIG. 3, but the microcomputer 12 is programmed so as to control the air-fuel ratio by a method different from the control method shown in FIG. 5. Namely, the microcomputer 12 of the electronic control unit 2 uses one of its memory locations for selectively storing one of the skip constants $K_1$ and $K_2$ (which for example are two kinds of control constant values) in response to the operating state at a first operational stage of the internal combustion engine, and the control unit 2 promptly and rapidly changes the air-fuel ratio by an amount corresponding to the selected and stored skip constant upon reaching a second, subsequent operational stage. Speaking in detail, when the engine is shifted to the idling operating condition from the partial operating condition, which constitutes the first operational stage, one of the two skip constants $K_1$ and $K_2$ is selected and stored in dependence on the value of the air-fuel ratio correction signal in comparison to a set upper limit value 50 (FIG. 6C). Next, at the subsequent second stage, which occurs when the engine is shifted from the idling operating state to the partial range, the air-fuel ratio is promptly and rapidly changed to a lean air-fuel ratio value which corresponds to the selected skip constant stored in the skip constant memory location.

Figure 7:
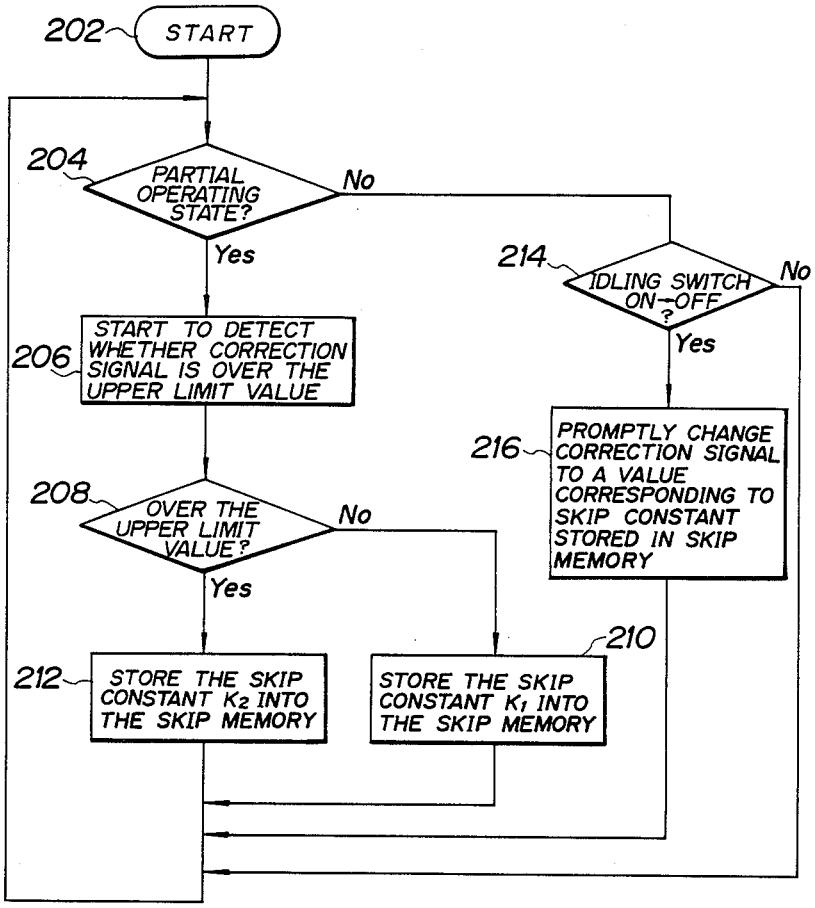
FIG. 7 is a flowchart of the operation of the second embodiment.

The operation of the second embodiment will now be described with reference to the flowchart shown in FIG. 7.

The illustrated program begins at step 202. A check is made in step 204 to see whether the internal combustion engine is in the operating condition in the partial range rather than the idling operating condition. If it is determined in step 204 that the engine operating condition is in the partial range, then in step 206 a comparison of the air-fuel ratio correction signal to the set upper limit value 50 is started. Then, a check is made in step 208 to see if the air-fuel ratio correction signal has exceeded the upper limit value 50 or not. If not, namely if the air-fuel ratio correction signal is presently less than the value 50 as at 52 in FIG. 6C, then the skip constant $K_1$ is stored into the skip constant memory location in step 210. In contrast, if in step 208 the air-fuel ratio correction signal is found to exceed the upper limit value 50 as at 54 in FIG. 6C, then the skip constant $K_2$ is stored into the memory location in step 212. The skip amount of the skip constant $K_2$ is larger than that of the skip constant $K_1$, so that the air-fuel ratio correction signal will be set to a leaner value at the second stage. Namely, the skip constant for the air-fuel ratio is fundamentally preset for subsequent use.

To determine whether the engine has reached the second stage, a check is made in step 214 to see if the internal combustion engine has been shifted from the idling operating condition to the running state, namely whether the idling switch 18 has been turned from on to off. If the idling switch is found to be on in step 214, then the engine is in the state in which the idling operating condition continues. In this state, the processing routine is advanced to step 204 because a deviation from normal feedback control is unnecessary. When it is ultimately determined in step 214 that the idling switch 18 has been turned from on to off the air-fuel ratio correction signal is promptly and rapidly changed by an amount corresponding to the skip constant $K_1$ or $K_2$ previously stored in the memory location. That is, as shown in FIG. 6C, when the air-fuel ratio correction signal at the first stage was lower than the upper limit value 50 and skip constant $K_1$ was stored, the air-fuel ratio correction signal is promptly changed at the second stage from the level 56 of the idling operating condition by an amount corresponding to the skip constant $K_1$ so that a first lean air-fuel ratio 58 is achieved. Alternatively, when the air-fuel ratio correction signal at the first stage was above the upper limit value 50 and skip constant $K_2$ was stored, the air-fuel ratio correction signal is promptly changed at the second stage from the level 56 of the idling operating condition by an amount corresponding to the skip constant $K_2$ so that a second lean air-fuel ratio 60 is achieved which is leaner than the first lean air-fuel ratio 58. Thus, a proper air-fuel ratio correction signal 62 for driving of the engine at a high altitude can be promptly achieved due to the control with the value of the skip constant $K_2$.

In the transient condition where the engine is shifted from the idling operating condition to the partial operating condition, hitherto a time lag occurred in the change of the air-fuel ratio correction signal to the level 62, as evident from the wide dark line 70 in FIG. 6C, so that the quantity of CO produced is relatively large, as shown by the hatched region surrounded by the wide dark line 72 in FIG. 6D. However, according to the second embodiment of the invention, when the engine is shifted from the idling operating condition to the partial operating condition, the air-fuel ratio correction signal can be promptly changed to a lean air-fuel ratio by the skip constant $K_2$ so as to avoid the time lag present in conventional control schemes, so that the quantity of CO can be remarkably reduced, as indicated by the thin line 64 in FIG. 6D, thereby making it possible to contribute to cleaning of the exhaust gas. In addition, according to the second embodiment, the arrangement required is simple, reliability is high, and the air-fuel ratio correction signal can be promptly and accurately controlled.

Another embodiment of the present invention will now be explained with reference to FIGS. 3, 8A to 8D, and 9. The components of the air-fuel ratio control apparatus in this embodiment are the same as those in the foregoing embodiment, namely as shown in FIG. 3. The air-fuel ratio is controlled with this apparatus in a manner different from the method depicted in the flow chart of FIG. 5.

Referring again to FIG. 3, the ECU 2 controls the air-fuel ratio of the carburetor 4 in a feedback manner. The ECU 2 determines whether or not the engine is in the transient operating condition when the operating state is shifted from the idling state to the partial operating state, for example by using ON-OFF signals of the idling switch 18. When the engine is in the partial operating condition, a control constant which determines the slope of the air-fuel ratio correction signal is changed from a value $R_1$ to a larger value $R_2$. Then, the air-fuel ratio is corrected and controlled on the basis of the set air-fuel ratio correction value $R_2$ for only a predetermined period of time $T_1$ determined by a timer (not shown) in the ECU, in accordance with the flowchart shown in FIG. 9, which is discussed below.

As described above, the ECU 2 includes: the reference voltage comparator 8 which compares to a reference voltage the output signal from the $O_2$ sensor 6 serving as the exhaust sensor; the input circuit 10 adapted to receive output signals from the reference voltage comparator 8, idling switch 18, engine speed sensor 20, etc.; the microcomputer 12 which controls the engine operating conditions on the basis of the output signal from the input circuit 10; and the driving circuit 16 which transmits to the control valve 14 a control signal which is produced by the microcomputer 12. Reference numeral 22 designates the ignition switch and reference numeral 24 designates the battery.

FIGS. 8A to 8D correspond in general to FIGS. 4A to 4D; therefore, separate detailed descriptions of them are omitted.

Figure 9:
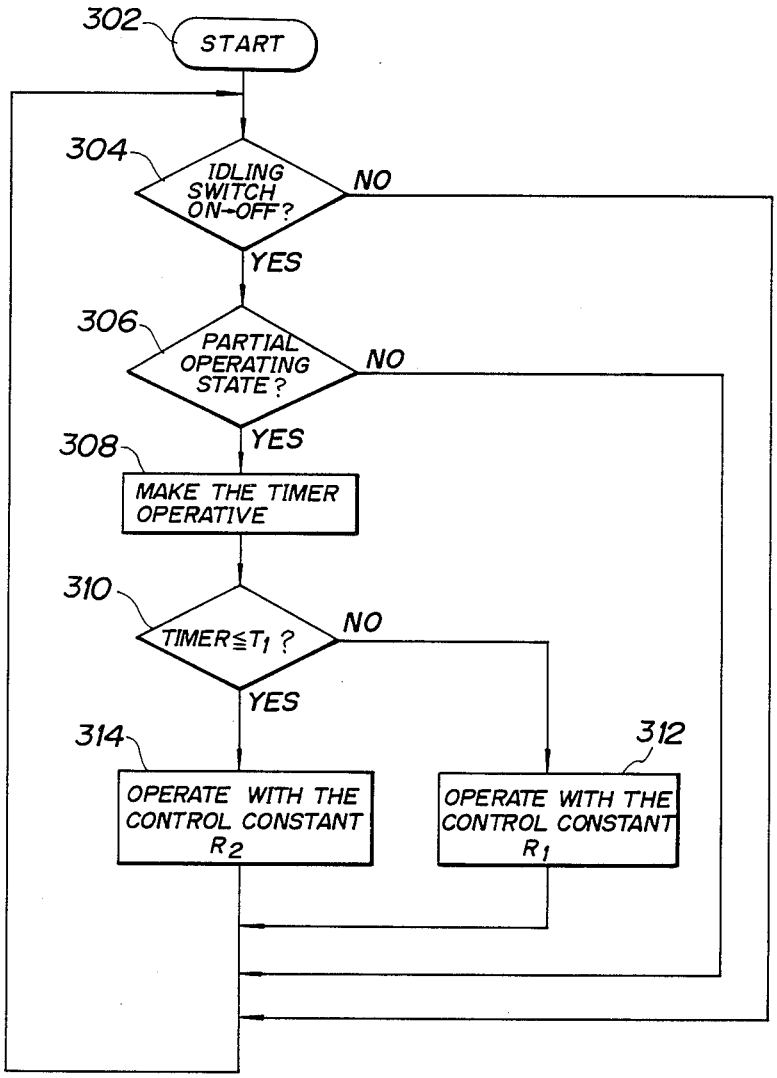
FIG. 9 is a flowchart of the operation of another embodiment shown in FIGS. 8A to 8D.

The operation of the control apparatus in this embodiment will now be explained with reference to the flowchart of FIG. 9.

In step 302, the internal combustion engine is first actuated or started. A check is then made to see if the idling switch 18 has changed from on to off (step 304). If the idling switch 18 is still on, this detection of the ON-OFF output signal of the idling switch 18 is repeated until the idling switch is turned off. When it is determined that the switch 18 is off in step 304, a check is made to see if the engine is in the partial operating state (step 306). If it is not, the processing routine is returned to the detection step 304. On the other hand, if the engine is in the partial operating state, a timer (not shown) in the ECU 2 is made operative (step 308). Next, a check is made to see if the time of the timer is shorter than a predetermined time period of $T_1$ seconds (step 310). If it is not, namely if the time of the timer is longer than the preset time of $T_1$ seconds, the air-fuel ratio correction value (for example an integration constant) is set to an ordinary value $R_1$ to thereby control the air-fuel ratio so that changes therein occur at a rate or with a slope of $R_1$ (step 312). On the other hand, if it is determined in step 310 that the time of the timer is shorter than or equal to $T_1$ seconds, the control constant $R_1$ of the air-fuel ratio correction value is set to $R_2$, which is slightly larger than the value $R_1$, and the air-fuel ratio is controlled on the basis of the air-fuel ratio correction value $R_2$ so that changes therein occur at a rate or with a slope of $R_2$.

Figure 8A:
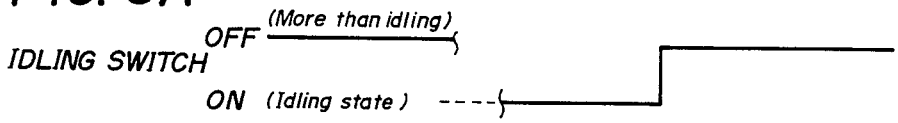
FIGS. 8A to 8D are timing charts showing operational characteristics of another embodiment of the invention.
Figure 8B:
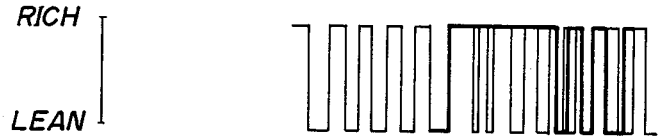
Figure 8C:
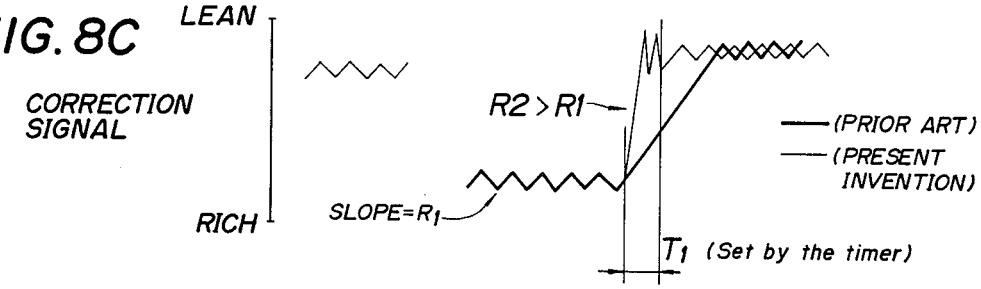
Figure 8D:
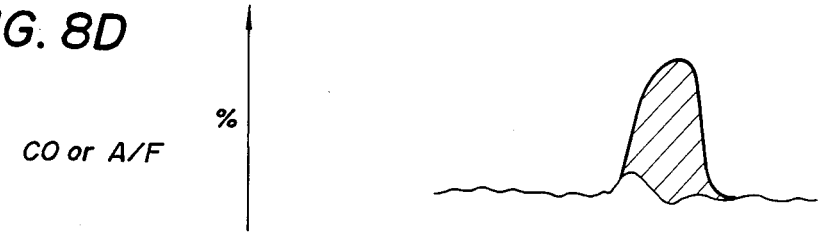

Due to this control procedure, in the transient operating state when the engine is shifted from the idling state to the partial operating state, the air-fuel ratio can be corrected and controlled by way of setting the control constant of the air-fuel ratio correction value to be a slightly larger value for only a predetermined period of time, as specifically shown in FIG. 8C, so that changes in the correction signal occur at a faster rate. The time delay of the requisite correction which occurs in a conventional arrangement can thus be avoided and it is possible to prevent the air-fuel ratio from being unnecessarily enriched, thereby contributing to a reduction in the quantity of harmful CO gas in the exhaust or to a decrease in the A/F (air-fuel) value, as shown in FIG. 8D.

On one hand, the use of this air-fuel ratio control apparatus when operating the engine at a high altitude enables a large time delay in the correction control to be avoided and also enables the quantity of CO in the exhaust to be reduced. Therefore, this embodiment is practically useful.

In the foregoing embodiment, the transient operating condition when the engine is shifted from the idling state to the partial operating state is detected by way of the ON-OFF signal from the idling switch. However, the transient operating condition may also be detected by one or more of various sensing devices such as the idling switch, a throttle opening switch, a vacuum switch, a high-altitude switch which detects operation at a high altitude, or the like.

As described in detail above, according to this embodiment the control constant of the air-fuel ratio correction value is set to a large value for only a predetermined period of time in the transient operating condition when the engine is shifted from the idling state to the partial operating state. Therefore, the time delay in the conventional correction control is avoided and it is possible to prevent the air-fuel ratio from being unnecessarily enriched. The quantity of harmful exhaust gases such as CO or the like can also be reduced. This embodiment is advantageous for a countermeasure to clear the restriction of the exhaust gas. In addition, the above-mentioned inventive correction control for the air-fuel ratio can be easily realized by merely changing a control program for the microcomputer of a conventional microcomputer-based ECU, so that costs can be reduced.

Another embodiment of the present invention will now be explained with reference to FIGS. 3, 10A to 10D, and 11. The components of the air-fuel ratio control apparatus in this embodiment are the same as those in the foregoing embodiment, namely as shown in FIG. 3. However, the air-fuel ratio is controlled with this apparatus in a manner different from the method depicted in the flowchart of FIG. 5.

Referring again to FIG. 3, the ECU 2 normally controls the air-fuel ratio of the carburetor 4 in a feedback manner. The ECU 2 determines whether or not the engine is in the transient operating condition when the operating state is shifted from the idling state to the partial operating state, for example by using ON-OFF signals of the idling switch I8. When the engine enters the partial operating condition (at point M in FIG. 8C), a control constant which determines the slope of the air-fuel ratio correction signal is changed from a value R1 to a larger value R2 until the correction signal reaches a predetermined fixed value P (at point N in FIG. 8C), so as to set the engine in a lean state. Time Ts represents the time lag from point M to point N which is required for changing the air-fuel ratio correction signal to the value P. The air-fuel correction signal is then maintained at the fixed value P for a predetermined period of time $T_1$ defined by a timer, in accordance with the flowchart of FIG. 9, which is discussed below. Thereafter, or in other words after point Q, normal feedback control at a slope $R_1$ is resumed.

As described above, the ECU 2 includes: the reference voltage comparator 8 which compares to a reference voltage the output signal from the $O_2$ sensor 6 serving as the exhaust sensor; the input circuit 10 adapted to receive output signals from the reference voltage comparator 8, idling switch 18, engine speed sensor 20, etc.; the microcomputer 12 which controls the engine operating conditions on the basis of the output signals from the input circuit 10; and the driving circuit 16 which transmits to the control valve 14 a control signal which is produced by the microcomputer 12. Reference numeral 22 designates the ignition switch and reference numeral 24 designates the battery.

FIGS. 10A to 10D correspond in general to FIGS. 4A to 4D; therefore, separate detailed descriptions of them are omitted.

Figure 11:
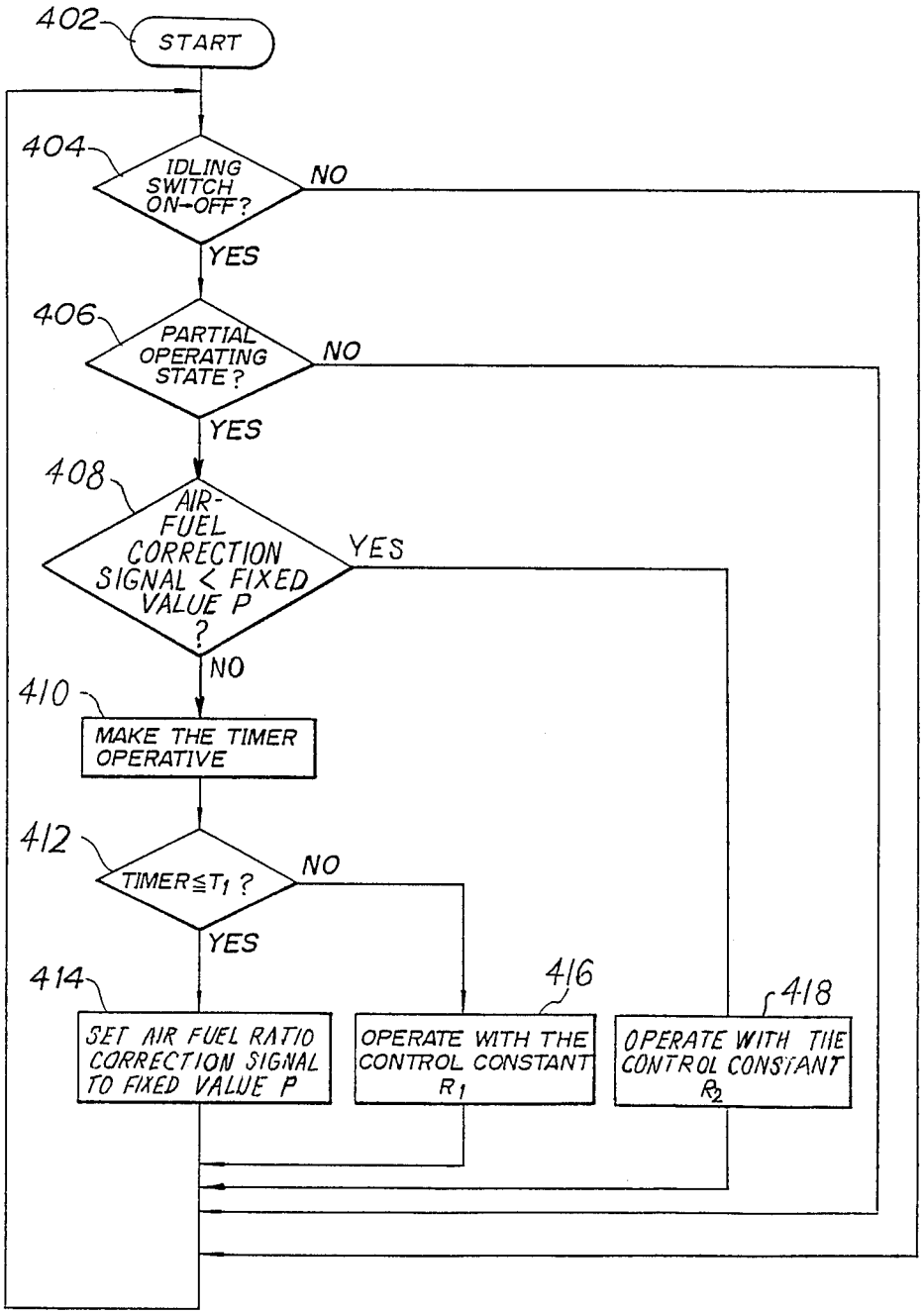
FIG. 11 is a flowchart of the operation of the embodiment shown in FIGS. 10A to 10D.

The operation of the control apparatus in this embodiment will now be explained with reference to the flowchart of FIG. 11

In step 402, the internal combustion engine is first actuated or started. A check is then made to see if the idling switch 18 has changed from on to off (step 404). If the idling switch 18 is still on, this detection of the ON-OFF output signal of the idling switch 18 is repeated until the idling switch is turned off. When it is determined that the switch 18 is off in step 404, a check is made to see if the engine is in the partial operating state (step 406). If it is not, the processing routine is returned to the detection step 304. On the other hand, if the engine is in the partial operating state, a check is made at step 408 to see if the air-fuel ratio correction signal is less than the fixed value P. If the correction signal is below the level P, then at step 418 feedback control is continued, but with the control constant R2 rather than the control constant $R_1$, so as to rapidly change the engine to the lean state. When it is ultimately detected at step 408 that the correction signal is not below the level P, then a timer in the ECU 2 is made operative (step 410). Next, a check is made at step 412 to see if the time of the timer is shorter than the predetermined time period of $T_1$ seconds. If it is not, namely if the time of the timer is longer than the preset time of $T_1$ seconds, the air-fuel ratio correction value (for example an integration constant) is set to the normal value $R_1$ to thereby control the air-fuel ratio so that changes therein occur at a rate or with a slope of $R_1$ (step 416). ON the other hand, if it is determined in step 412 that the time of the timer is shorter than or equal to $T_1$ seconds, the air-fuel ratio correction signal is maintained at the fixed value P at step 414.

Figure 10A:
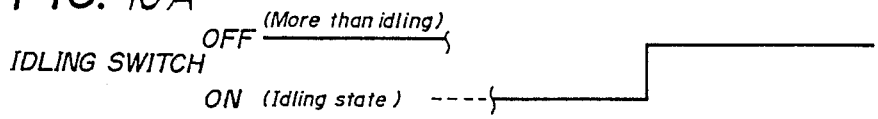
FIGS. 10A to 10D are timing charts showing operational characteristics of another embodiment of the invention.
Figure 10B:
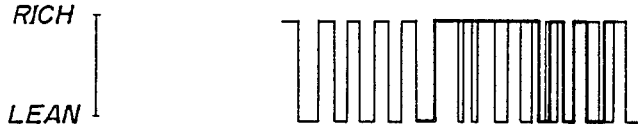
Figure 10C:
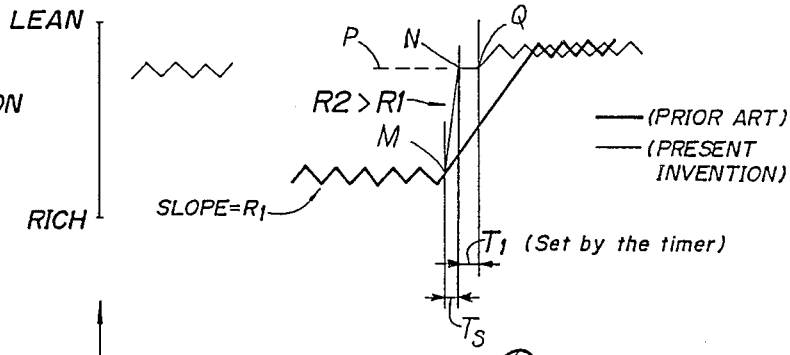
Figure 10D:
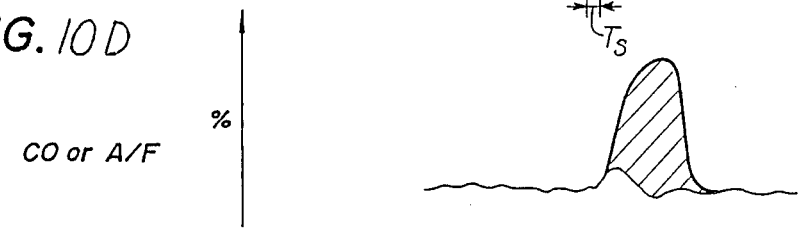

Due to this control procedure, in the transient operating state when the engine is shifted from the idling state to the partial operating state, the air-fuel ratio correction value is changed to the predetermined fixed value P, and then this fixed value P is maintained for a predetermined period of time, and then the air-fuel ratio is controlled on the basis of an ordinary air-fuel ratio correction value through feedback after the lapse of the predetermined period of time, as specifically shown in FIG. 10C. The time delay of the requisite correction which occurs in a conventional arrangement can thus be avoided, and it is possible to prevent the air-fuel ratio from being unnecessarily enriched, thereby contributing to a reduction in the quantity of harmful CO gas in the exhaust or to a decrease in the A/F (air-fuel) value, as shown in FIG. 10D.

Further, the use of the control apparatus of the invention in the operation of the engine at high altitude enables the large time delay in the conventional correction control to be avoided and makes it possible to reduce the quantity of CO in the exhaust. Therefore, the invention is practically advantageous.

The present invention is not limited to the foregoing embodiments, since many modifications and variations, including the rearrangement of parts, are possible within the spirit and scope of the appended claims of the invention.

What is claimed is:

1. An apparatus for controlling an air-fuel ratio of an internal combustion engine, comprising:

first sensor means for detecting a concentration of an exhaust gas;

second sensor means for detecting when the engine is shifted from an idling operating state to a transient operating conditions;

an electronic control unit having signal processing means for receiving output signals from said first and second sensor means, for processing said output signals, and for generating a control signal; and an electronically controlled carburetor having a control which controls the air-fuel ratio of the engine in response to said control signal from said electronic control unit;

wherein said signal processing means has first means for maintaining said control signal at a predetermined value for a predetermined interval of time in response to said second sensor detecting that said engine has shifted to said transient operating condition; and wherein said signal processing means includes second means responsive to said control signal being below said predetermined value when said second sensor detects that said engine has shifted to said transient operating condition for rapidly changing said control signal to said predetermined value, said first means thereafter maintaining said control signal at said predetermined value for said predetermined interval of time.

2. An apparatus according to claim 1, wherein said signal processing means changes said control signal at a first rate in response to said signal from said first sensor means (1) when said engine is in said idling operating state and (2) following said predetermined interval of time when said engine is in said transient operating condition.

3. An apparatus according to claim 2, wherein said second means of said signal processing means changes said control signal at a second rate substantially greater than said first rate in order to effect said rapid change of said control signal.

4. An air-fuel ratio control apparatus according to claim 1, wherein said first sensor means is an $O_2$ sensor for detecting the concentration of oxygen in the exhaust gases.

5. An air-fuel ratio control apparatus according to claim 1, wherein said second sensor means is an idling switch which generates an output signal indicative of said transient operating condition of the engine.

6. An air-fuel ratio control apparatus according to claim 1, wherein said signal processing means in said electronic control unit includes a microcomputer.

* * * * *

UNITED STATES PATENT AND TRADEMARK OFFICE

CERTIFICATE OF CORRECTION

PATENT NO. : 4 872 117

DATED : October 3, 1989

INVENTOR(S) : Fujiyuki SUZUKI et al

It is certified that error appears in the above-identified patent and that said Letters Patent is hereby corrected as shown below:

Column 11, line 25; after "trol" insert ---valve---.

line 31; after "sensor" insert ---means---.

Column 12, line 4; after "sensor" insert ---means---.

Signed and Sealed this

Twenty-third Day of October, 1990

*Attest:*

HARRY F. MANBECK, JR.

*Attesting Officer*

*Commissioner of Patents and Trademarks*